US009133647B2

(12) United States Patent
Oh et al.

(10) Patent No.: US 9,133,647 B2
(45) Date of Patent: Sep. 15, 2015

(54) NFC OR BLE BASED CONTACTLESS LOCK WITH CHARGE MONITORING OF ITS ENERGY STORAGE

(71) Applicant: NEXKEY, INC., Menlo Park, CA (US)

(72) Inventors: Sooseok Oh, San Jose, CA (US); Matthew Patrick Herscovitch, Melbourne (AU)

(73) Assignee: NEXKEY, INC., Menlo Park, CA (US)

( * ) Notice: Subject to any disclaimer, the term of this patent is extended or adjusted under 35 U.S.C. 154(b) by 0 days.

(21) Appl. No.: 14/475,456

(22) Filed: Sep. 2, 2014

(65) Prior Publication Data

US 2015/0102904 A1 Apr. 16, 2015

Related U.S. Application Data

(60) Provisional application No. 61/890,053, filed on Oct. 11, 2013.

(51) Int. Cl.
*G08B 21/00* (2006.01)
*E05B 21/06* (2006.01)
(Continued)

(52) U.S. Cl.
CPC ..... *E05B 21/066* (2013.01); *E05B 35/00* (2013.01); *E05B 47/0001* (2013.01); *E05B 47/0012* (2013.01); *E05B 47/0038* (2013.01); *G07C 9/00309* (2013.01); *G07C 2009/00634* (2013.01)

(58) Field of Classification Search
CPC . H04L 63/0492; H04L 63/10; E05B 47/0611; E05B 2047/0084
USPC ..... 340/5.1, 5.2, 5.7, 5.61, 5.71; 70/277, 70/278; 235/382
See application file for complete search history.

(56) References Cited

U.S. PATENT DOCUMENTS 4,031,434 A 6/1977 Perron et al.
4,837,822 A 6/1989 Crosley et al.
(Continued)

FOREIGN PATENT DOCUMENTS

EP 0846823 A1 6/1998
WO 2010127389 A1 11/2010
WO 2013068344 A1 5/2013

OTHER PUBLICATIONS

International Search Report and Written Opinion for PCT/AU2010/000508 Mailed Jul. 5, 2010 (15 pages).
(Continued)

*Primary Examiner* — Mark Rushing
(74) *Attorney, Agent, or Firm* — Perkins Coie LLP

(57) ABSTRACT

Some embodiments include electronic circuitry for an electronic lock. The electronic circuitry can include: an antenna configured to receive a wireless signal; a communication processor, coupled to the antenna, configured to decode the wireless signal to ascertain a command to lock or unlock the electronic lock and to authenticate a source of the wireless signal; an energy storage configured to store electrical energy; a motor switch configured to drive a motor clockwise or counterclockwise, powered by the energy storage, depending on a control signal, wherein the motor switch is configured to drive the motor for a short burst of time; and a controller, coupled to the energy storage capacitor and the motor switch, configured to monitor electrical charge left in the energy storage and to output the control signal that corresponds to the command to lock or unlock the electronic lock.

23 Claims, 5 Drawing Sheets

(51) Int. Cl.

| | |
|---|---|
| ***E05B 35/00*** | (2006.01) |
| ***E05B 47/00*** | (2006.01) |
| ***G07C 9/00*** | (2006.01) |

(56) References Cited

U.S. PATENT DOCUMENTS

| | | | | |
|---|---|---|---|---|
| 5,617,082 | A | 4/1997 | Denison et al. | |
| 5,782,118 | A | 7/1998 | Chamberlain et al. | |
| 6,072,402 | A | 6/2000 | Kniffin et al. | |
| 6,731,731 | B1 | 5/2004 | Ueshima | |
| 7,716,483 | B2 | 5/2010 | Sozzani et al. | |
| 8,035,478 | B2 | 10/2011 | Lee | |
| 8,052,059 | B2 | 11/2011 | Saito et al. | |
| 8,922,333 | B1 * | 12/2014 | Kirkjan | 340/5.1 |
| 2003/0179073 | A1 | 9/2003 | Ghazarian | |
| 2006/0164206 | A1 | 7/2006 | Buckingham et al. | |
| 2007/0131005 | A1 | 6/2007 | Clare | |
| 2007/0176738 | A1 | 8/2007 | Horler | |
| 2008/0150680 | A1 * | 6/2008 | Casey et al. | 340/5.7 |
| 2008/0316120 | A1 | 12/2008 | Hirota et al. | |
| 2012/0108168 | A1 | 5/2012 | Metivier et al. | |
| 2012/0145782 | A1 * | 6/2012 | Ma et al. | 235/379 |
| 2013/0335193 | A1 * | 12/2013 | Hanson et al. | 340/5.61 |
| 2014/0218167 | A1 * | 8/2014 | Tseng | 340/5.61 |
| 2015/0004937 | A1 * | 1/2015 | Kremen et al. | 455/411 |

OTHER PUBLICATIONS

U.S. Appl. No. 13/318,526 of Hart, J., et al., filed Jan. 13, 2012.

Non-Final Office Action Mailed Sep. 11, 2013 in U.S. Appl. No. 13/318,526 of Hart, J., et al., filed Jan. 13, 2012.

Final Office Action Mailed Mar. 26, 2014 in U.S. Appl. No. 13/318,526 of Hart, J., et al., filed Jan. 13, 2012.

International Search Report and Written Opinion mailed Apr. 9, 2015, for International Application No. PCT/US2014/060154, 6 pages.

* cited by examiner

NFC OR BLE BASED CONTACTLESS LOCK WITH CHARGE MONITORING OF ITS ENERGY STORAGE

CROSS-REFERENCE TO RELATED APPLICATION(S)

This application claims the benefit of U.S. Provisional Patent Application No. 61/890,053, entitled "ELECTRONIC LOCKING SYSTEM AND METHOD," which was filed on Oct. 11, 2013, which is incorporated by reference herein in its entirety.

RELATED FIELD

At least one embodiment of this disclosure relates generally to a lock system, and in particular to an electronic lock system.

BACKGROUND

Wireless technology has advanced over the years enabling wireless security systems. Amongst them, electronic locks have been in development. For most security related gadgets, the deciding factors of whether or not to purchase a gadget may be cost (e.g., purchase cost and maintenance cost), operational usability, ease of installation and maintenance, and degree of security. Various existing solutions lack at least one of these factors.

DETAILED DESCRIPTION

Figure 1:
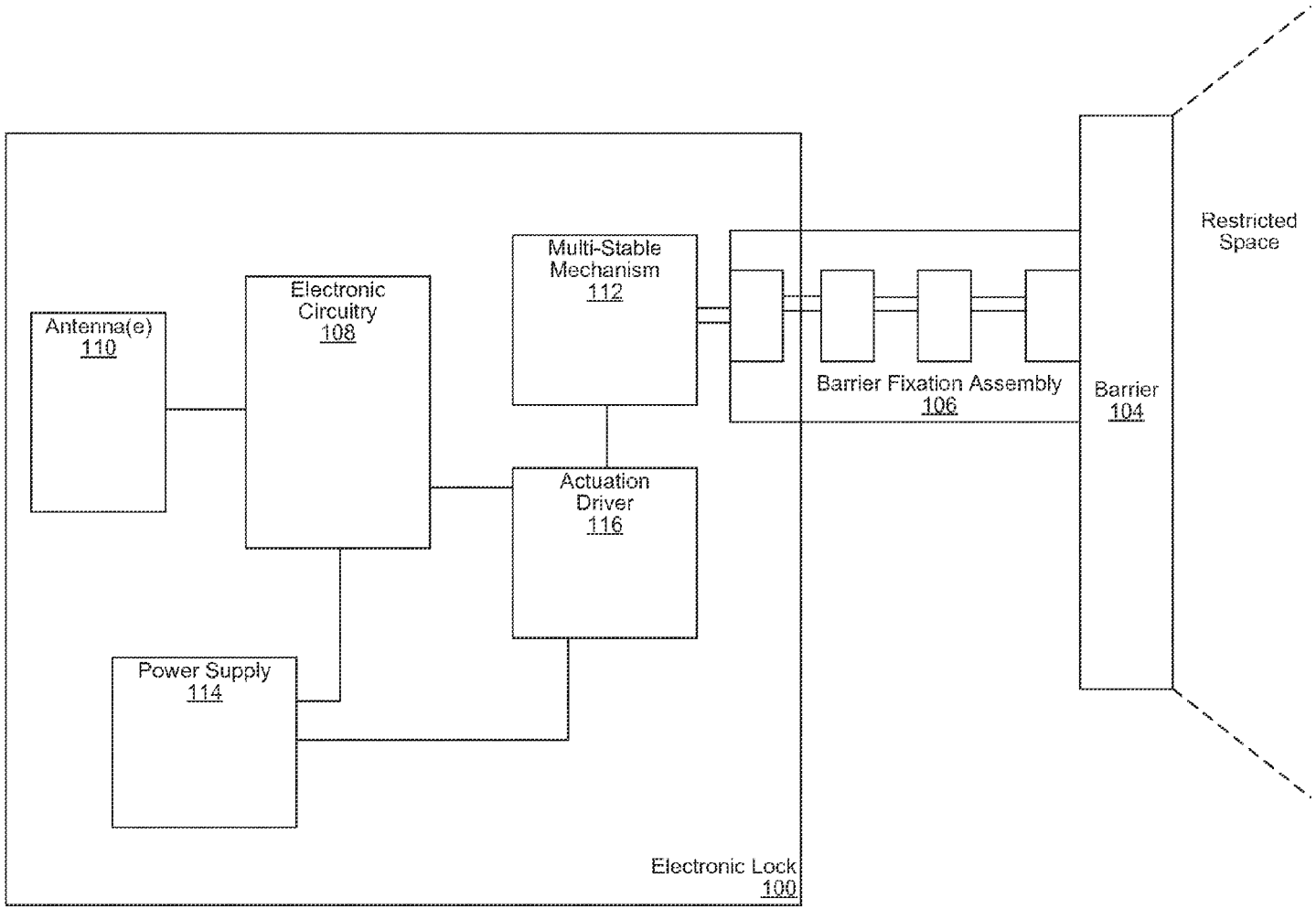
FIG. 1 is a block diagram of a system environment of an electronic lock securing access via a multi-stable mechanism, in accordance with various embodiments.

Disclosed are embodiments of an electronic circuitry to implement an electronic lock. In some embodiments, the electronic lock has a form factor of an electronic cylinder for ease of installation (e.g., as compared to replacing an entire lock assembly, replacing the lock cylinder would be much easier). The electronic lock may improve security while maintaining usability by using a short-range communication channel that is contactless (e.g., via the near field communication (NFC) protocol or the Bluetooth low energy (BLE) protocol). In some embodiments, the short-range communication protocols can be modified to decrease range by reducing the transmitter power and/or receiver sensitivity. A short-range communication channel can improve security by spatially limiting windows of opportunity for a potential malicious entity to interfere with a legitimate authentication process.

In some embodiments, the electronic lock includes an energy harvesting mechanism utilizing the same wireless signal of the short-range communication channel. For example, the electronic circuitry can harvest energy from the wireless signal into an energy storage device (e.g., a capacitor or a rechargeable battery). This is advantageous for various reasons. For example, this reduces the cost of maintenance by greatly extending the life of any battery in the electronic lock or freeing the electronic lock from requiring a battery in the first place. For another example, this improves security by temporally limiting windows of opportunity for a potential malicious entity to interfere with a legitimate authentication process. That is, the electronic lock can be free from electronic tampering when the wireless signal for both communication and energy harvesting is absent.

In some embodiments, the energy harvesting mechanism includes multiple channels. For example, the electronic lock can select a channel (e.g., NFC or induction) from amongst different channels and configure its circuitry to harvest energy from the channel. In some embodiments, the electronic lock can include multiple energy provisioning modalities of energy supply. That is, the energy harvesting mechanism may be one modality to provide energy to drive a motor inside the electronic lock. Other modalities can include a battery, a solar cell charger, a piezoelectric charger, etc. In some embodiments, multiple energy harvesting channels and/or multiple energy provisioning modalities can be active.

In some embodiments, the electronic circuitry can use a single antenna for both communication and energy harvesting. In some embodiments, the electronic circuitry can use at least two antennae for communication and for energy harvesting. The separation of antennae may be advantageous for various reasons. For example, the energy charging power train may be unstable due to the slow charging and rapid discharging from the energy storage. Having a separate antenna and a corresponding power train for communication independent of the power train for energy harvesting prevents disruptions to communication related processes of the electronic circuitry. For another example, the electronic circuitry may include a logical component (e.g., a microprocessor, an application-specific integrated circuit, a field programmable gate array (FPGA), other chip, or any combination thereof) to execute communication related processes and a logical component to execute motor control related processes. The two logical components may differ in terms of power requirements (e.g., different voltage and/or different current requirement). Separation of the communication and the energy harvesting channels enable both logical components to satisfy their requirements without added complexity for power switching. For yet another example, the communication channel may modulate the radio frequency (RF) field received through the communication channel antenna. Separation of the channels can prevent any adverse effects or inconvenience caused by such modulation.

When using two antennae, coupling and interference may occur. Accordingly, in at least some embodiments, the antenna for communication and the antenna for energy harvesting are adapted to differ in shape, in relative position, and in inductance level, or any combination thereof. In some embodiments, an electromagnetic shielding can be installed behind the antennae to protect them from interference from other components in the electronic circuitry.

FIG. 1 is a block diagram of a system environment of an electronic lock 100 securing access via a multi-stable mechanism 112, in accordance with various embodiments. For example, the electronic lock 100 can be a device that incorporates a bolt, cam, shackle or switch to secure an object, directly or indirectly, to a position, and that provides a restricted means of releasing the object from that position. The electronic lock 100 can be part of a locking system (i.e., a greater lock assembly that includes or is coupled to the electronic lock 100). For example, the electronic lock 100 may be embodied as a variety of locks and locking systems, such as a lock cylinder that is an integrated component (and cannot be removed from) a locking system, or, preferably as a lock cylinder that is designed to substitute for a replaceable lock cylinder component of a locking system. In either case, examples of locking systems that might include the electronic lock cylinder include, without limitation, deadbolts, door knob/lever locking systems, padlocks, locks on safes, U-locks such as those used for bicycles, cam locks such as those used to secure drawers or cabinets, window locks, etc. The electronic lock 100 is a set of mechanical and electronic components for preventing or allowing access to a restricted space. The electronic lock 100 can also perform authentication of an external object. The electronic lock 100 can be coupled (e.g., directly or indirectly) to a barrier 104, such as via a barrier fixation assembly 106 that secures the barrier 104. The barrier fixation assembly 106 comprises one or more interlocking components (e.g., a rotating plug with a locking pin, a housing shell, bolt hardware, or any combination thereof, along with a strike plate or other receiving location for bolt hardware, such as a hole in a door jamb) that together prevent movement of the barrier 104 when the barrier fixation assembly 106 is engaged. The electronic lock 100 can include or at least control one of the interlocking components.

The electronic lock 100 can prevent or allow access through the barrier based on the result of the authentication process. For example, the authentication process can include the electronic lock 100 receiving an electronic key (i.e., information used to authenticate) via electronic circuitry 108. The electronic circuitry 108 can include or be coupled to one or more antenna(e) 110 for receiving wireless signal encoded with the electronic key. For example, the antenna(e) can receive an electronic key (e.g., identity information from a computing device, for example a mobile device, such as a smart phone, a wearable device, or a key fob, possessed by a user who is requesting access). The electronic key can positively identify the user and may enable the authentication and/or authorization of the user for access. Accordingly, the electronic lock 100 does not require a keyhole, because the electronic key can be obtained wirelessly without physical contact with the source of the electronic key. The electronic lock 100, or the locking system in which it resides, may include a keyhole to enable a "backup" method of unlocking by use of a physical key, or to enable removing the electronic lock cylinder from the front of the locking system as is commonly implemented with certain mechanical lock cylinders marketed as "interchangeable core" lock cylinders.

In some embodiments, the antennae 110 may also harvest power from the wireless signal they receive. For example, a first antenna can be associated with a communication channel (e.g., for receiving the identity information) and a second antenna can be associated with an energy harvesting channel for storing electrical energy into an energy storage (e.g., capacitor or rechargeable battery) coupled to the antenna. In some embodiments, the communication channel can separately harvest power needed to operate a logical component (e.g., a communication chip or microprocessor) for performing communication related or authentication related processes.

In some embodiments, the electronic lock 100 allows or prevents entry by switching between stable configurations of the multi-stable mechanism 112, each corresponding to a locked state or an unlocked state of the electronic lock 100. The multi-stable mechanism 112 is a mechanical structure in the electronic lock 100 that has at least two stable configurations, wherein energy is consumed to move from one stable configuration to another, but no additional energy is consumed to maintain one of the stable configurations mechanically. For example, if the multi-stable mechanism 112 is not already at an intended state, the electronic lock 100 switches between states of the multi-stable mechanism 112 by actuating a mechanical driver (e.g., a DC motor or a solenoid actuator) coupled to the multi-stable mechanism 112. For example, the mechanical driver can rotate a rotor that is part of the multi-stable mechanism 112 when switching between the stable configurations. In this example, different rotational positions of the rotor can correspond to different stable configurations where the rotor is held in place without external energy. Different rotational positions of the rotor can also correspond to a locked state or an unlocked state, depending on whether a short span (e.g., a slot or a short radius portion) in the rotor is aligned with a locking pin for the locking pin to retract.

The mechanical coupling of the multi-stable mechanism 112 at the locked state to at least a component of the barrier fixation assembly 106 prevents an external force from disengaging the barrier fixation assembly 106 from the barrier 104, which serves to prevent access to a restricted space. Similarly, the mechanical coupling (or lack thereof) of the multi-stable mechanism 112 at the unlocked state to at least a component of the barrier fixation assembly 106 can enable an external force to disengage an interlocking component that directly or indirectly fixates the barrier 104.

In some embodiments, the electronic lock 100 includes a power supply 114. The power supply 114 can be coupled to the electronic circuitry 108 and/or an actuation driver 116. The power supply 114 can be a battery, a capacitor coupled to an energy harvesting mechanism, a renewable energy source (e.g., solar, piezoelectric, human powered generator), a wireless charger coupled to an energy storage device, a power interface to an external power source, or any combination thereof.

Figure 2A:
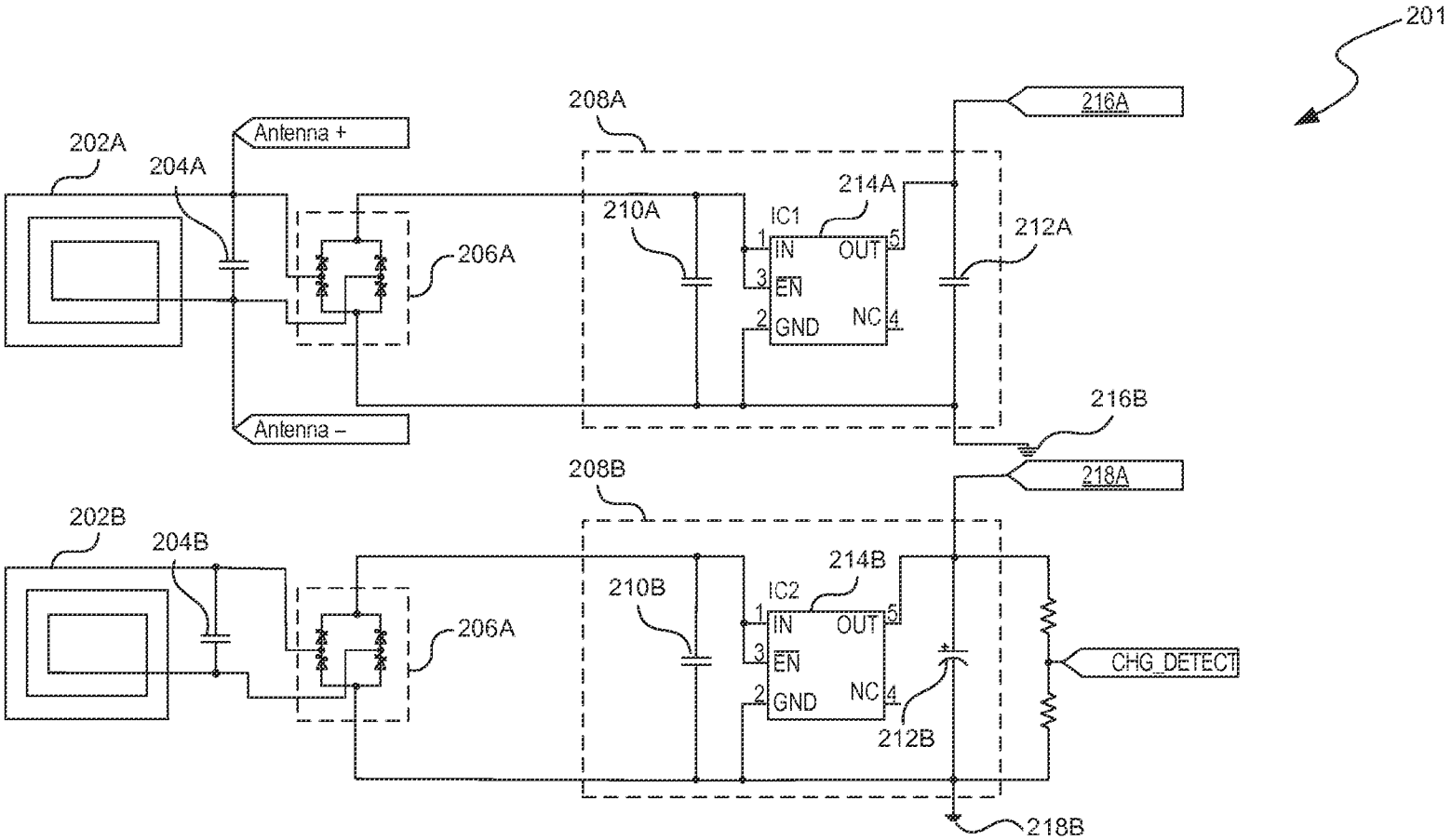
FIG. 2A is a circuit diagram of an antenna circuit of an electronic circuitry in an electronic lock, in accordance with various embodiments.

FIG. 2A is a circuit diagram of an antenna circuit 201 of an electronic circuitry (e.g., the electronic circuitry 108 of FIG. 1) in an electronic lock (e.g., the electronic lock 100 of FIG. 1), in accordance with various embodiments. The antenna circuit 201 includes a first antenna 202A and a second antenna 202B (collectively as the "antennae 202"). The antennae 202 can be used to receive wireless signals and/or to generate wireless signals. The antenna circuit 201 can include voltage regulation mechanisms to harvest energy to convert into DC voltage to power one or more components in the electronic circuitry.

In some embodiments, the first antenna 202A and the second antenna 202B are configured to receive near field communication (NFC) signals at a specific frequency (e.g., 13.56 MHz). In some embodiments, the first antenna 202A and the second antenna 202B are configured to receive wireless signals at different frequencies and/or using different communication protocols (e.g., one for Bluetooth LE and one for NFC). In embodiments where the first antenna 202A and the second antenna 202B are separate, the shapes of the antennae 202 are adapted to be different to minimize coupling and/or interference. Further, positioning of and air gaps between the antennae 202 may be adapted to minimize coupling and/or interference. Yet further, inductances of the antennae 202 may be adapted to be different to minimize coupling and/or interference. In some embodiments, the first antenna 202A and the second antenna 202B can have the same diameter and/or length (e.g., 2 cm). In some embodiments, the antennae 202 have different diameters and/or lengths. In some embodiments, the antennae 202 can have different numbers of windings/turns. For example, the first antenna 202A can have 8 turns while the second antenna 202B can have 12 turns. In some embodiments, different numbers of turns/windings and the air gap between the antennae 202 help prevent the antennae 202 from coupling. By compensating with different capacitive values or by adjusting the number of turns, the antennae 202 can lock onto the same frequency but avoid coupling.

Each of the antennae 202 can be coupled in parallel to matching capacitors 204. For example, the first antenna 202A can be coupled to a first matching capacitor 204A and the second antenna 202B can be coupled to a second matching capacitor 204B. The first matching capacitor 204A and the second matching capacitor 204B can have different capacitance to compensate for different number of turns/windings of the antennae 202. The matching capacitors (e.g., the first matching capacitor 204A and the second matching capacitor, collectively as the "matching capacitors 204") may be adapted to match the impedance and/or the reactance of the antennae 202 for the desired frequency to reduce or remove mismatch loss.

In some embodiments, the matching capacitors 204 can be replaced respectively with dynamic impedance tuners. For example, a first dynamic impedance tuner can replace the first matching capacitor 204A. The first dynamic impedance tuner is capable of adjusting an impedance associated with the first antenna 202A. For another example, a second dynamic impedance tuner can replace the second matching capacitor 204B. The second dynamic impedance tuner is capable of adjusting an impedance associated with the second antenna 202B. For example, the dynamic impedance tuners can comprise a set of multiple capacitors, each with a different capacitance. The dynamic impedance tuner may be capable of coupling to its respective antenna with a subset of the multiple capacitors upon an adjustment command from a controller. The dynamic impedance tuners, for example, can adjust capacitance, inductance, or both associated with the antennae 202. For example, the dynamic impedance tuners can make adjustments to the impedance value associated with the antennae 202 to compensate for different transmission conditions (e.g., ambient humidity or differences of the signal source, such as when different mobile devices are used to communicate with the antennae 202).

Each of the antennae 202 can further be coupled in parallel to rectifiers 206. For example, the first antenna 202A can be coupled to a first rectifier 206A and the second antenna 202B can be coupled to a second rectifier 206B. The rectifiers (e.g., the first rectifier 206A and the second rectifier 206B, collectively as the "rectifiers 206") convert alternating current (AC) signals received respectively through the antennae 202 into direct current (DC) voltages.

The DC outputs of the rectifiers 206 can be coupled in parallel to voltage regulation assemblies 208 (e.g., a linear voltage regulator assembly 208A and a linear voltage regulator assembly 208B, collectively as the "voltage regulation assemblies 208"). The voltage regulation assemblies 208 can also include, for example, Zener diodes, switching regulators, or a boost converter. For example, the first rectifier 206A can be coupled to the linear voltage regulator assembly 208A and the second rectifier 206B can be coupled to the linear voltage regulator assembly 208B. Each of the voltage regulation assemblies 208 can have an input capacitor (e.g., an input capacitor 210A or an input capacitor 210B), an output capacitor (e.g., an output capacitor 212A or an output capacitor 212B), and a linear voltage regulator (e.g., a linear voltage regulator 214A or a linear voltage regulator 214B). The input capacitor and the output capacitor can be used to stabilize the input or output voltages when the respective linear voltage regulator changes its current draw or when the received signal from one of the antennae 202 changes.

The output capacitors 212A and 212B serve not only to stabilize the voltage but also to store energy harvested from the antennae 202. The output capacitor 212A may store energy to provide a substantially constant DC voltage to power a communication circuit 230 (shown in FIG. 2B). The output capacitor 212B may store energy to run a motor controller (e.g., in a motor control circuit 270 shown in FIG. 2C) and to power a motor to actuate a rotor in the electronic lock. For example, the rotor can be used to control whether or not a lock cylinder can be rotated by an external force.

To provide power to a motor, the output capacitor 212B can have significantly higher capacitance than the output capacitor 212A. In some embodiments, the output capacitor 212A and the output capacitor 212B can be replaced instead with alternative energy storage such as a rechargeable battery. In some embodiments, the input capacitor 210A and the input capacitor 210B can have the same capacitance.

In embodiments where the antennae 202 are separate, the first antenna 202A, the first matching capacitor 204A, the first rectifier 206A, and the linear voltage regulator assembly 208A can be considered a "communication channel" portion of the antenna circuit 201. Likewise, the second antenna 202B, the second matching capacitor 204B, the second rectifier 206B, and the linear voltage regulator assembly 208B can be considered an "energy harvesting channel" portion of the antenna circuit 201.

In some embodiments, the output of the linear voltage regulator assembly 208A is coupled to a communication component at a communication channel output 216, which consists of a positive terminal 216A and a negative terminal 216B. For example, the communication component can be the communication circuit 230. In some embodiments, the output of the linear voltage regulator assembly 208B is coupled to a motor control component at a harvesting channel output 218, which consists of a positive terminal 218A and a negative terminal 218B. For example, the motor control component can be the motor control circuit 270.

In some embodiments, the communication channel and the energy harvesting channel can be combined into one. For example, the first antenna 202A and the second antenna 202B can be a single antenna coupled to a single matching capacitor, a single rectifier, and a single voltage regulator. To run the communication circuit 230 and the motor control circuit 270 in these embodiments, the antenna circuit 201 may require additional voltage stabilizing circuitry and/or power delimiter at the antenna or at the voltage regulator. Alternatively, the antenna circuit 201 may be controlled to perform the communication and the energy harvesting sequentially using the same set of antenna, matching capacitor, rectifier, and voltage regulator. For example, the communication channel can utilize the antenna first before the energy harvesting channel. In another example, the energy harvesting channel can utilize the antenna first before the communication channel.

Figure 2B:
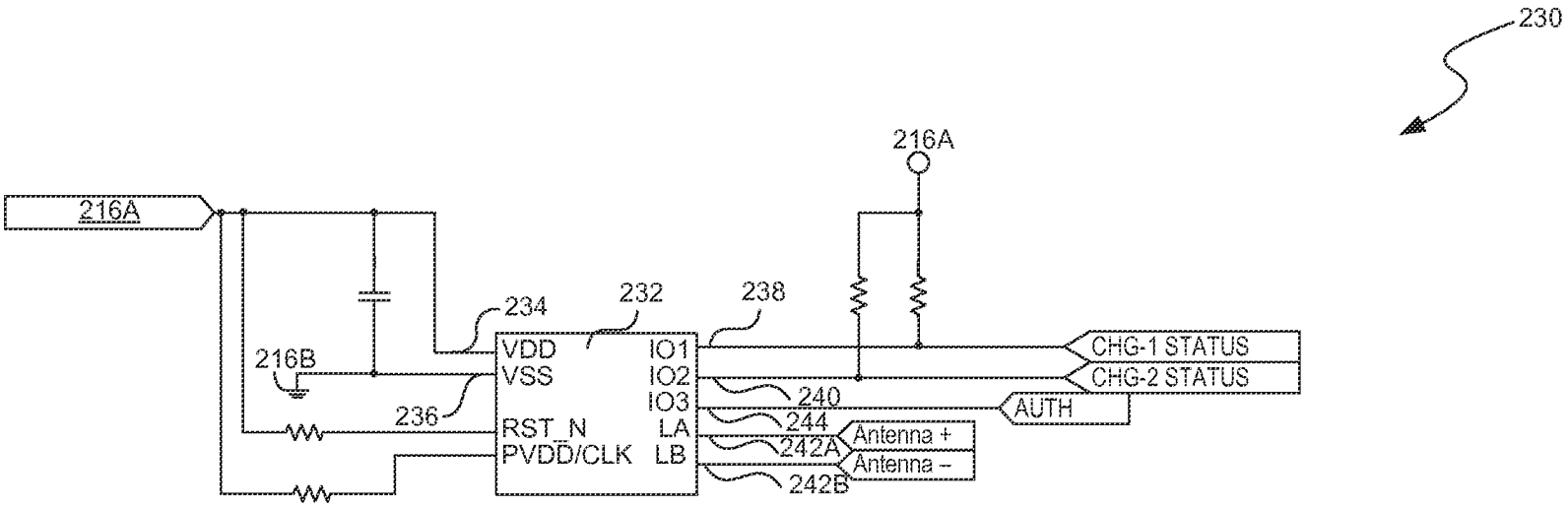
FIG. 2B is a circuit diagram of a communication circuit coupled to the antenna circuit of FIG. 2A in the electronic circuitry, in accordance with various embodiments.

FIG. 2B is a circuit diagram of a communication circuit 230 coupled to the antenna circuit 201 of FIG. 2A in the electronic circuitry, in accordance with various embodiments. The communication circuit 230 is coupled to the output of the linear voltage regulator assembly 208A at the communication channel output 216.

The communication circuit 230 includes a communication processor 232. The communication processor 232, for example, can be a NFC processor, a RFID chip, or a Bluetooth LE processor. The communication processor 232 can be powered via a positive power supply pin 234 coupled to the positive terminal 216A of the communication channel output 216. A negative power supply pin 236 of the communication processor 232 can be coupled to ground or the negative terminal 216B of the communication channel output 216.

In some embodiments, the communication circuit 230 and the motor control circuit 270 are connected via a conductive interconnect (e.g., one or more wires between one or more I/O pins of the communication processor 232 and a controller 274 in the motor control circuit 270). In some embodiments, the communication circuit 230 and the motor control circuit 270 are connected via a digital interface, such as a digital bus.

The communication processor 232 derives its power from wireless signals received at the first antenna 202A. This enables the communication processor 232 to operate independently of the energy harvesting channel. The harvesting channel output 218 may have unstable variations in voltage and/or current due to a slow charging of the output capacitor 212B and/or a sudden discharge of the output capacitor 212B. These unstable variations are undesirable when running a digital processor such as the communication processor 232. Likewise, the communication processor 232 may cause variations in voltage and/or current depending on whether the communication processor 232 is executing an intensive operation (e.g., writing to flash memory or performing cryptographic operations) and thus drawing more power.

The communication processor 232 can include a first charge status pin 238. The communication processor 232 can also include a second charge status pin 240. The first charge status pin 238 and the second charge status pin 240 can both be connected to the motor control circuit 270 of FIG. 2C to determine the charge status of the energy harvesting channel. In some embodiments, more than one charge status pins can be used to convey additional bits of information. In one specific example, with two charge status pins, four states can be tracked. In some embodiments, there can be no charge status pin.

The communication processor 232 can be coupled to the positive and negative terminals of the first antenna 202A via an antenna positive pin 242A and an antenna negative pin 242B. This enables the communication processor 232 to monitor modulation of the wireless RF signal received at the first antenna 202A. The communication processor 232 can also use the antenna positive pin 242A and the antenna negative pin 242B to modulate an RF field (e.g., the RF field generated by a computing device that can provide an electronic key to the electronic lock) using the first antenna 202A to send messages or feedback to the computing device (e.g., a mobile device or a key fob).

The communication processor 232 can include an authentication pin 244. The authentication pin 244 enables the communication processor 232 to communicate with the motor control circuit 270. For example, upon decoding the RF signal received through the first antenna 202A, the communication processor 232 can determine whether identity information encoded in the RF signal matches an authorized user. In response to determining that the identity information matches an authorized user, the communication processor 232 can generate a signal through the authentication pin 244 to notify the motor control circuit 270 to unlock the electronic lock (e.g., when the electronic lock is not already unlocked), or to lock the electronic lock (e.g., when the electronic lock is not already locked). In response to determining that the identity information does not match an authorized user or matches an explicitly unauthorized user, the communication processor 232 can generate a signal through the authentication pin 244 to notify the motor control circuit 270 to lock the electronic lock (e.g., when the electronic lock is not already locked).

In embodiments with the first dynamic impedance tuner replacing the first matching capacitor 204A, the communication processor 232 is configured to determine the impedance of the first dynamic impedance tuner to minimize signal noise through the first antenna 202A. The communication processor 232 can be configured to associate a device type of the signal source or a user identifier of the signal source to the determined impedance. The communication processor 232 can be configured to cycle through different capacitance and/or inductance at the dynamic impedance tuner to determine the impedance.

In some embodiments, the communication circuit 230 can be coupled with a battery or other power source (e.g., solar, mechanical generator, etc.) to supplement or replace energy harvested from the first antenna 202A. Instead of or in addition to drawing power from the energy stored by the output capacitor 212A of the antenna circuit 201 to power the communication processor 232, the communication processor 232 may draw power from the battery. The battery can enable the communication circuit 230 to actively generate a signal to initiate communications with a computing device that provides an electronic key to the electronic lock. In the specific example of using NFC as the communication protocol, there are at least three modes of operation for the communication circuit 230. The communication circuit 230 can be an initiator, in which case it would generate an RF field; or it can be a target, in which case it modulates the field generated by the initiator. For example, when the communication circuit 230 operates in the "target" mode, the computing device, such as a smart phone, communicates via the NFC protocol in the "initiator" mode. In this case, the computing device generates an RF field that powers the communication circuit 230. That is, the communication processor 232 can operate without a power source and can derive its power from the NFC field generated by the computing device. However, in the case where a battery is powering the communication processor 232, the communication processor 232 may act as the initiator. In that scenario, the communication processor 232 generates the RF field, and the computing device that contains the electronic key may harvest this energy to power itself, in which case the computing device may be batteryless, e.g. a smart card. In other embodiments, with the addition of a battery, the communication circuit 230 can be configured in a card emulation mode. In this case, the communication circuit 230, although powered by a battery, does not generate the RF field, but rather modulates the RF field generated by the computing device.

Figure 2C:
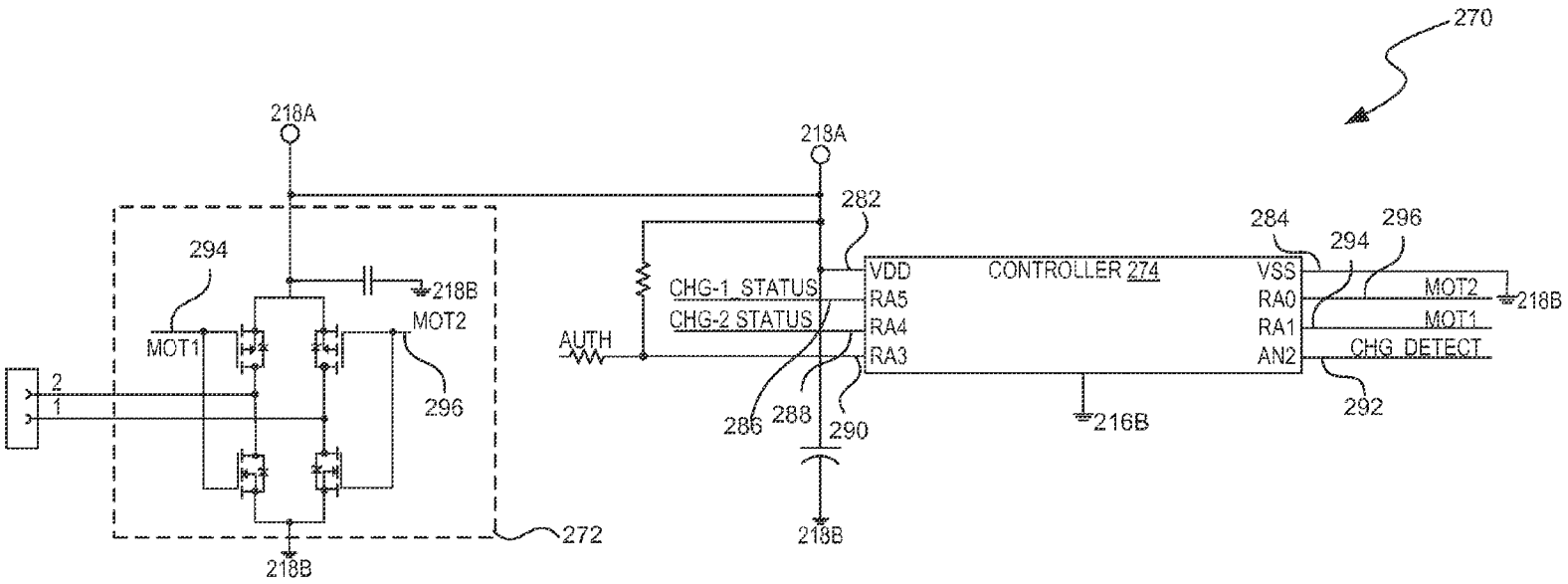
FIG. 2C is a circuit diagram of a motor control circuit coupled to the antenna circuit of FIG. 2A and the communication circuit of FIG. 2B in the electronic circuitry, in accordance with various embodiments.

FIG. 2C is a circuit diagram of a motor control circuit 270 coupled to the antenna circuit 201 of FIG. 2A and the communication circuit 230 of FIG. 2B in the electronic circuitry, in accordance with various embodiments. The motor control circuit 270 is coupled to the output of the linear voltage regulator assembly 208B at the harvesting channel output 218. The motor control circuit 270 can include a motor switch circuit 272. The motor switch circuit 272 can turn a motor clockwise, counterclockwise, or disconnect power from the motor depending on motor control signals from the controller 274. For example, the motor switch circuit 272 can disconnect power from the motor when there is no control signal. The controller 274, for example, can be a microprocessor or microcontroller.

The motor switch circuit 272 can include multiple transistors (e.g., bipolar transistors, MOSFET transistors, etc.). At least a set of the transistors can be coupled to a first terminal of the motor and a set of transistors can be coupled to a second terminal of the motor. For example, when the first terminal of the motor is connected to the positive terminal 218A of the harvesting channel output 218, the second terminal is connected to the negative terminal 218B of the harvesting channel output 218 or ground, the motor turns in a clockwise direction. When the first terminal of the motor is connected to the negative terminal 218B of the harvesting channel output 218 or ground and the second terminal is connected to the positive terminal 218A of the harvesting channel output 218, the motor turns in a counterclockwise direction. In various embodiments, the clockwise motion and the counterclockwise motion can each correspond to a locked state or an unlocked state of the electronic lock.

The controller 274 can be configured to receive power from the positive terminal 218A of the harvesting channel output 218 at a positive power pin 282. The controller 274 can be configured to reference either ground or the negative terminal 218B of the harvesting channel output 218 at a negative power pin 284. The controller 274 can be configured to indicate the charge status of the output capacitor 212B through the communication circuit 230 at a first charge status pin 286 and a second charge status pin 288. For example, the first charge status pin 286 can be coupled to the first charge status pin 238 of FIG. 2B and the second charge status pin 288 can be coupled to the second charge status pin 240 of FIG. 2B. The controller 274 can be configured to monitor the authentication signal from the communication circuit 230 at an authentication status pin 290.

The controller 274 can be configured to monitor a voltage level of the output capacitor 212B at a charge detection pin 292. In some embodiments, the output capacitor 212B can store the energy harvested from the second antenna 202B (e.g., by harvesting a NFC signal or other inductive or radiofrequency signal). In other embodiments, the output capacitor 212B can additionally or instead store energy harvested from another energy harvesting mechanism, such as a solar or piezoelectric charger. The charge detection pin 292 can be coupled to a voltage divider between the positive terminal 218A and the negative terminal 218B of the harvesting channel output 218 to monitor the charge left in the output capacitor 212B, which stores the harvested energy from the second antenna 202B. The controller 274 can quantify the charge level into a charge status (e.g., ⅓ full, ⅔ full, and completely full). The charge status may be passed onto the communication processor 232 (e.g., via the charge status pin 288) to be communicated to a computing device that has the electronic key. In the embodiments where the computing device is a mobile device, the mobile device can show the charge status on its display. In other embodiments, the electronic lock can include an output device (not shown), such as a display or a speaker, that presents the charge status.

The controller 274 can also include a first motor control pin 294 and a second motor control pin 296, both connected to the motor switch circuit 272. When a voltage is applied at the first motor control pin 294 and the second motor control pin 296 is grounded, the motor switch circuit 272 can turn the motor clockwise. When a voltage is applied at the second motor control pin 296 and the first motor control pin 294 is grounded, the motor switch circuit 272 can turn the motor counterclockwise.

In some embodiments, the controller 274 and the motor switch circuit 272 are configured to drive the motor for short bursts of time (e.g., using a discrete amount of energy). For example, the use of the discrete amount of energy is made possible by a multi-stable mechanism in the electronic lock that is able to prevent or allow a locking pin to disengage. The motor can change the multi-stable mechanism from a locked configuration to an unlocked configuration or vice versa. The multi-stable mechanism can hold the locked configuration or the unlocked configuration without the motor being active. In other embodiments, the controller 274 and the motor switch circuit 272 are configured to drive the motor continuously.

In some embodiments, the controller 274 can monitor the charge level (e.g., via the charge detection pin 292) such that when sufficient power is accumulated in the output capacitor 212B and the communication processor 232 indicates that the signal source is authenticated (e.g., as indicated through the authentication pin 290), the controller 274 can generate the control signal (e.g., via the first motor control pin 294 and/or the second motor control pin 296) for the motor switch circuit 272 to lock or unlock the electronic lock. In some embodiments, the controller 274 can monitor the charge level such that when the output capacitor 212B falls below a charge threshold, the remaining energy in the output capacitor 212B is used to lock the electronic lock (e.g., by generating a control signal corresponding to the command to lock to the motor switch circuit 272).

In embodiments with the second dynamic impedance tuner replacing the second matching capacitor 204B, the controller 274 can be configured to determine the impedance of the second dynamic impedance tuner to optimize energy flux through the second antenna 202B. The controller 274 can be configured to associate a device type of the signal source or a user identifier of the signal source to the determined impedance. The controller 274 can be configured to cycle through different capacitance and/or inductance at the dynamic impedance tuner to determine the impedance.

In some embodiments, the controller 274 can be configured to perform the task related to the operation of the motor switch circuit 272. The controller 274 or the communication processor 232 can be configured to communicate with the signal source or to forward messages through the signal source to external systems. In some embodiments the controller 274 can track the charging time, signal noise, and/or the impedance values of the dynamic impedance tuners.

In some embodiments, the communication circuit 230 and the motor control circuit 270 can be combined as an integrated chip designed with the functionalities of both circuits. In some embodiments, the antenna circuit 201, the communication circuit 230, and the motor control circuit 270 can be integrated as a single chip or circuit board. In some embodiments, the communication processor 232 and the controller 274 can be general-purpose computing devices configured by software instructions. In some embodiments, the communication processor 232 and the controller 274 can be special purpose computing devices with hardcoded functionalities.

In some embodiments, the communication circuit 230 and the communication processor 232 are illustrated as a NFC processor. However, this disclosure also contemplates embodiments where the communication circuit 230 is configured as a Bluetooth LE circuit and the communication processor 232 is a processor configured as a Bluetooth LE processor. For example, a mobile device that provides an electronic key (e.g., identity information used to authenticate a user) can communicate with the electronic lock through Bluetooth LE and provide power to the electronic lock through NFC via the energy harvesting channel of the antenna circuit 201. In those embodiments, the first antenna 202A can be configured to the frequency of the Bluetooth LE and the second antenna 202B can be configured to the frequency of the NFC protocol.

It is noted that various components of the electronic circuitry can be combined into a single part or divided out into separate parts. For example, a single capacitor can be divided out into two or more capacitors connected together in series, in parallel, or a combination thereof. For another example, the first antenna 202A and the second antenna 202B can be combined into a single antenna or divided out into multiple antennae.

In some embodiments, at least some of the functionalities of the communication processor 232 can be implemented by the controller 274 or another controller or processor. In some embodiments, at least some of the functionalities of the controller 274 can be implemented by the communication processor 232 or another controller or processor. For example, in some embodiments where the communication processor 232 is configured to handle Bluetooth LE messages, the communication processor 232 can receive a message containing an electronic key using the Bluetooth LE protocol via the first antenna 202A. The communication processor 232 can then pass the electronic key to a crypto processor to decrypt and/or authenticate the message. The crypto processor can then notify the controller 274 to lock or unlock the electronic lock. In some embodiments, the crypto processor can be integrated with the controller 274.

In some embodiments, the motor control circuit 270 is adapted to control another mechanical driver instead of a motor. For example, the motor control circuit 270 can be adapted to control an actuator, such as a solenoid actuator.

Figure 3:
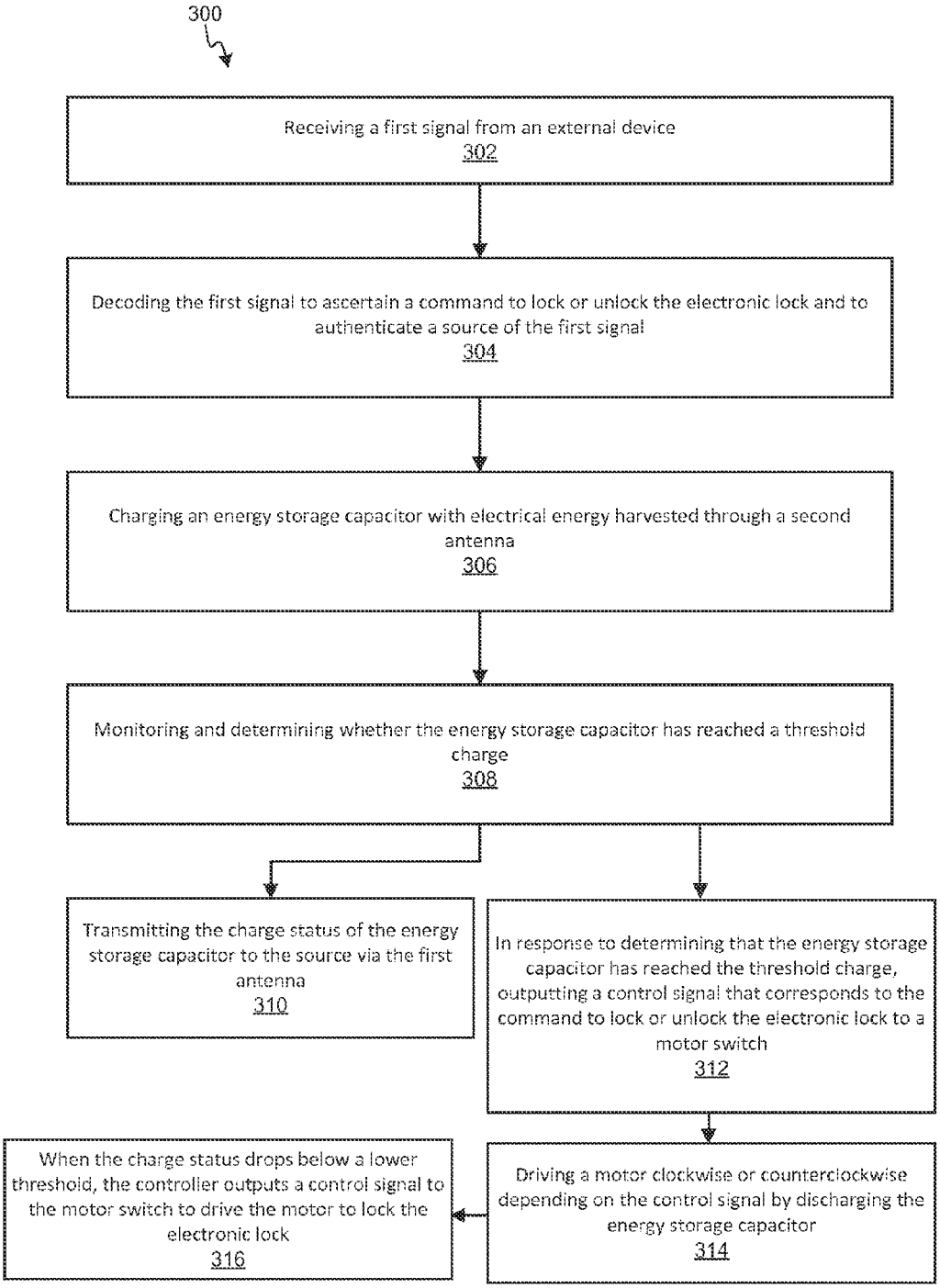
FIG. 3 is a flow chart of a method of operating electronic circuitry of an electronic lock, in accordance with various embodiments The figures depict various embodiments of this disclosure for purposes of illustration only. One skilled in the art will readily recognize from the following discussion that alternative embodiments of the structures and methods illustrated herein may be employed without departing from the principles of the invention described herein.

FIG. 3 is a flow chart of a method 300 of operating electronic circuitry (e.g., the electronic circuitry 108 of FIG. 1 or the electronic circuitry of FIGS. 2A-2C) of an electronic lock (e.g., the electronic lock of FIG. 1), in accordance with various embodiments. For example, the electronic lock can be an electronic lock cylinder. At step 302, a first antenna (e.g., the first antenna 202A of FIG. 2A) can receive a first signal (e.g., NFC signal or Bluetooth LE signal) from an external device. At step 304, a communication component (e.g., the communication processor 232 of FIG. 2B, such as a NFC processor or a Bluetooth processor) can decode the first signal to ascertain a command to lock or unlock the electronic lock and to authenticate a source of the first signal. In some embodiments, the communication component can decipher a list of authorized users from the first signal and authenticate that the list of authorized users by verifying a digital signature of a security server stored in a memory of the communication component. The list of authorized users can then be used to authenticate the source and any future device corresponding with the communication component through the first antenna.

At step 306, an energy harvesting circuit component (e.g., the energy harvesting channel of the antenna circuit 201 of FIG. 2A) can charge an energy storage capacitor (e.g., the output capacitor 212B of FIG. 2A) with electrical energy harvested through a second antenna (e.g., the second antenna 202B of FIG. 2A). In some embodiments, step 306 can occur before step 304. In some embodiments, step 306 can occur independent of whether the user is authenticated. The electrical energy can have the same frequency as the first signal and can be from the same source (e.g., a mobile device or a key fob capable of NFC communication).

At step 308, a controller (e.g., the controller 274 of FIG. 2C) can monitor and determine whether the energy storage capacitor has reached a threshold charge. Meanwhile, the controller can update the charge status of the energy storage capacitor to the communication component. At step 310, the communication component can transmit the charge status of the energy storage capacitor to the source via the first antenna. For example, step 310 can include updating the charge status to the source periodically or in accordance with a schedule before the energy storage capacitor reaches the threshold charge.

In response to determining that the energy storage capacitor has reached the threshold charge, the controller can output, at step 312, a control signal that corresponds to the command to lock or unlock the electronic lock to a motor switch (e.g., the motor switch circuit 272 of FIG. 2C). At step 314, the motor switch can drive a motor clockwise or counterclockwise depending on the control signal by discharging the energy storage capacitor.

If the motor switch drove the motor to unlock, the controller can continue to monitor the charge status of the energy storage capacitor after unlocking the electronic lock. At step 316, when the charge status drops below a lower threshold, the controller outputs a control signal to the motor switch to drive the motor to lock the electronic lock.

While processes or blocks are presented in a given order, alternative embodiments may perform routines having steps, or employ systems having blocks, in a different order, and some processes or blocks may be deleted, moved, added, subdivided, combined, and/or modified to provide alternative or subcombinations. Each of these processes or blocks may be implemented in a variety of different ways. In addition, while processes or blocks are at times shown as being performed in series, these processes or blocks may instead be performed in parallel, or may be performed at different times.

The embodiments are described in sufficient detail to enable those skilled in the art to make and use the embodiments. It is to be understood that other embodiments would be evident based on the present disclosure, and that system, process, or mechanical changes may be made without departing from the scope described.

In the description, numerous specific details are given to provide a thorough understanding of the embodiments. However, it will be apparent that the embodiments may be practiced without these specific details. In order to avoid obscuring the embodiments, some well-known circuits, configurations, systems, and process steps may not have been disclosed in detail.

The drawings showing embodiments are semi-diagrammatic and not to scale and, particularly, some of the dimensions are for the clarity of presentation and are shown exaggerated in the drawing figures. Similarly, although the views in the drawings for ease of description generally show similar orientations, this depiction in the FIGs. is arbitrary for the most part. Generally, the embodiments can be operated in any orientation.

In addition, where multiple embodiments are disclosed and described having some features in common, for clarity and ease of illustration, description, and comprehension thereof, similar and like features one to another will ordinarily be described with similar reference numerals. The embodiments have been numbered first embodiment, second embodiment, etc. as a matter of descriptive convenience and are not intended to have any other significance or provide limitations.

While embodiments have been described in conjunction with a specific best mode, it is to be understood that many alternatives, modifications, and variations will be apparent to those skilled in the art in light of the aforegoing description. Accordingly, it is intended to embrace all such alternatives, modifications, and variations that fall within the scope of the included claims. All matters set forth herein or shown in the accompanying drawings are to be interpreted in an illustrative and non-limiting sense.

What is claimed is:

1. Electronic circuitry for an electronic lock cylinder, comprising:

a first antenna configured to receive a first near field communication (NFC) signal;

a NFC processor, coupled to the first antenna, configured to decrypt the first NFC signal to ascertain a command to lock or unlock the electronic lock cylinder and to authenticate a source of the first NFC signal;

a second antenna configured to receive a second NFC signal that has the same frequency as the first NFC signal, wherein the second antenna and the first antenna are adapted to avoid interference and coupling; and an energy storage capacitor configured to store electrical energy harvested from the second NFC signal through the second antenna;

a motor switch configured to drive a motor clockwise or counterclockwise by discharging the energy storage capacitor depending on a control signal; and a controller, coupled to the energy storage capacitor and the motor switch, configured to monitor whether the energy storage capacitor has reached an upper threshold charge and to output the control signal that corresponds to the command to lock or unlock the electronic lock cylinder when the energy storage capacitor has reached the upper threshold charge.

2. The electronic circuitry of claim 1, further comprising:

a communication-channel rectifier, coupled to the first antenna, adapted to rectify the first NFC signal; and a communication-channel linear voltage regulator, coupled to the communication-channel rectifier, to provide power to the NFC processor.

3. The electronic circuitry of claim 1, further comprising:

a harvesting-channel rectifier, coupled to the second antenna, adapted to rectify the second NFC signal; and a harvesting-channel linear voltage regulator, coupled to the harvesting-channel rectifier, to charge the energy storage capacitor.

4. The electronic circuitry of claim 1, wherein the first antenna and the second antenna have different shapes.

5. The electronic circuitry of claim 1, wherein the first antenna and the second antenna have different inductance.

6. The electronic circuitry of claim 1, wherein there is an air gap between the first antenna and the second antenna.

7. The electronic circuitry of claim 1, further comprising: a dynamic impedance tuner, coupled to the second antenna, capable of adjusting an impedance associated with the second antenna; wherein the controller is configured to determine the impedance of the dynamic impedance tuner to optimize energy flux through the second antenna.

8. The electronic circuitry of claim 7, wherein the controller is configured to associate a device type of the source or a user identifier of the source to the determined impedance.

9. The electronic circuitry of claim 7, wherein the controller is configured to cycle through different capacitance and/or inductance at the dynamic impedance tuner to determine the impedance.

10. The electronic circuitry of claim 7, wherein the dynamic impedance tuner comprises a set of multiple capacitors, each with a different capacitance, wherein the dynamic impedance tuner is capable of coupling to the second antenna with a subset of the multiple capacitors upon an adjustment command from the controller.

11. The electronic circuitry of claim 1, further comprising a dynamic impedance tuner, coupled to the first antenna, capable of adjusting an impedance associated with the first antenna; wherein the NFC processor is configured to adjust the impedance of the dynamic impedance tuner to minimize signal noise through the first antenna.

12. The electronic circuitry of claim 1, wherein the controller is further configured to monitor whether the energy storage capacitor has reached a lower threshold charge after outputting the control signal corresponding to the command to unlock, and to output a second control signal corresponding to the command to lock when the energy storage capacitor has reached the lower threshold charge.

13. The electronic circuitry of claim 1, wherein the NFC processor is coupled to an energy source including a battery, a solar power source, a piezoelectric power source, or any combination thereof.

14. The electronic circuitry of claim 13, wherein the NFC processor, powered by the energy source, is configured in card emulation mode to modulate the first NFC signal.

15. The electronic circuitry of claim 1, wherein the NFC processor is configured in a passive target mode that modulates the first NFC signal generated by a nearby initiator.

16. Electronic circuitry for an electronic lock, comprising:

an antenna configured to receive a signal, the signal configured under the near field communication (NFC) protocol or the Bluetooth low energy (BLE) protocol;

a communication processor, coupled to the antenna, configured to decrypt the signal to ascertain a command to lock or unlock the electronic lock and to authenticate a source of the signal;

an energy storage component configured to store electrical energy;

a motor switch configured to drive a motor clockwise or counterclockwise, powered by the energy storage component, depending on a control signal, wherein the motor switch is configured to drive the motor for a short burst of time; and a controller, coupled to the energy storage component and the motor switch, configured to monitor electrical charge left in the energy storage component and to output the control signal that corresponds to the command to lock or unlock the electronic lock;

wherein the communication processor is configured to communicate according to the Bluetooth LE protocol, but with a lower transmission power and/or a diminished receiver sensitivity compared to what is specified in the Bluetooth LE protocol standards.

17. The electronic circuitry of claim 16, wherein the communication processor and the controller are implemented together on a single integrated circuit.

18. A method of operating an electronic circuitry for an electronic lock cylinder, comprising:

receiving a first wireless signal from an external device at a first antenna;

decoding the first wireless signal to ascertain a command to lock or unlock the electronic lock cylinder and to authenticate a source of the first wireless signal;

charging an energy storage capacitor with electrical energy harvested through a second antenna, wherein the second antenna is configured to receive a second wireless signal from the source of the first wireless signal, wherein the second wireless signal is at a different frequency than the first wireless signal;

determining whether the energy storage capacitor has reached a threshold charge;

in response to determining that the energy storage capacitor has reached the threshold charge, outputting a control signal that corresponds to the command to lock or unlock the electronic lock cylinder; and driving a motor clockwise or counterclockwise depending on the control signal by discharging the energy storage capacitor.

19. The method of claim 18, wherein the first wireless signal is configured as a Bluetooth LE signal using a Bluetooth LE protocol and the second wireless signal is configured as a NFC signal using a NFC protocol.

20. The method of claim 18, further comprising transmitting a charge status of the energy storage capacitor to the source via the first antenna.

21. The method of claim 20, wherein said transmitting includes updating the charge status periodically or in accordance with a schedule before the energy storage capacitor reaches the threshold charge.

22. The method of claim 20, wherein said decoding includes deciphering a list of authorized users from the first NFC signal and authenticating that the list of authorized users by verifying a digital signature of a security server stored in a memory of a NFC communication component.

23. The method of claim 18, wherein the second wireless signal uses a different communication protocol as to the first wireless signal.

* * * * *